US010871306B2

(12) United States Patent
Lanning et al.

(10) Patent No.: US 10,871,306 B2
(45) Date of Patent: Dec. 22, 2020

(54) MODULAR DRAIN PANS FOR HVAC SYSTEMS

(71) Applicant: Johnson Controls Technology Company, Auburn Hills, MI (US)

(72) Inventors: Michael S. Lanning, Brandon, FL (US); Christian C. Herbeck, Largo, FL (US); Jeremy S. Morris, Ruskin, FL (US); Joshua J. Yagy, St. Petersburg, FL (US)

(73) Assignee: Johnson Controls Technology Company, Auburn Hills, MI (US)

( * ) Notice: Subject to any disclaimer, the term of this patent is extended or adjusted under 35 U.S.C. 154(b) by 30 days.

(21) Appl. No.: 16/249,408

(22) Filed: Jan. 16, 2019

(65) Prior Publication Data

US 2020/0208872 A1 Jul. 2, 2020

Related U.S. Application Data

(60) Provisional application No. 62/787,684, filed on Jan. 2, 2019.

(51) Int. Cl.
*F24F 13/22* (2006.01)
*F24F 140/30* (2018.01)

(52) U.S. Cl.
CPC ..... *F24F 13/222* (2013.01); *F24F 2013/228* (2013.01); *F24F 2140/30* (2018.01)

(58) Field of Classification Search
CPC .... B65D 81/26; B65D 81/261; B65D 81/262; B65D 81/3813; B65D 81/3806;
(Continued)

(56) References Cited

U.S. PATENT DOCUMENTS 4,809,851 A * 3/1989 Oestreich, Jr. ..... B65D 7/32 206/599
4,916,919 A * 4/1990 Kim, II ..... F24F 13/22 62/272

(Continued)

FOREIGN PATENT DOCUMENTS

CN 203605327 5/2014
EP 2600075 6/2013

(Continued)

*Primary Examiner* — Don M Anderson
(74) *Attorney, Agent, or Firm* — Fletcher Yoder, P.C.

(57) ABSTRACT

A drain pan for a HVAC system includes a middle section defining a cavity extending from a first end of the middle section to a second end of the middle section, a first end section configured to partially extend into the cavity via the first end of the middle section, and a second end section configured to partially extend into the cavity via the second end of the middle section. The second end section includes a drain port. In some embodiments, the drain pan is modular, enabling different middle sections of various lengths to be coupled between the end sections. The cavity of some embodiments is formed by double walls, which insulate the middle section to reduce condensate formation on a bottom surface of the middle section. By forming one or multiple sections from plastic with an anti-microbial additive, the drain pan further reduces corrosion, microbial growth, and/or condensate generation.

29 Claims, 8 Drawing Sheets

(58) Field of Classification Search
CPC .... B65D 21/08; B65D 21/083; B65D 21/086; F24F 13/22; F24F 2013/225
USPC ..... 220/571, 4.01, 4.03, 4.31, 4.32, 8, 4.26, 220/4.27
See application file for complete search history.

(56) References Cited

U.S. PATENT DOCUMENTS

| | | | | |
|---|---|---|---|---|
| 5,161,709 | A * | 11/1992 | Oestreich, Jr. ..... | B65D 19/12 220/1.5 |
| 5,452,739 | A * | 9/1995 | Mustee ..... | A47L 15/4212 137/312 |
| 6,062,032 | A | 5/2000 | Yoon | |
| 6,105,383 | A | 8/2000 | Reimann et al. | |
| 6,112,536 | A | 9/2000 | Hansen | |
| 6,240,740 | B1 | 6/2001 | Endo et al. | |
| 6,321,556 | B1 | 11/2001 | Tesche et al. | |
| 6,343,480 | B1 | 2/2002 | Correa et al. | |
| 6,360,911 | B1 | 3/2002 | Arnold | |
| 6,405,552 | B1 | 6/2002 | Hubert et al. | |
| 6,708,516 | B2 | 3/2004 | Nakagawa et al. | |
| 6,895,770 | B1 | 5/2005 | Kaminski | |
| 6,901,766 | B1 | 6/2005 | Jin et al. | |
| 7,418,827 | B2 | 9/2008 | Rios | |
| 7,430,877 | B2 | 10/2008 | Davenport et al. | |
| 7,637,387 | B1 | 12/2009 | Cantolino | |
| 7,708,052 | B2 | 5/2010 | Leman et al. | |
| 7,878,019 | B2 * | 2/2011 | Cantolino ..... | F24F 13/222 62/285 |
| 7,900,795 | B1 * | 3/2011 | Cantolino ..... | F24F 13/222 220/608 |
| 7,992,405 | B2 | 8/2011 | Cushen | |
| 8,006,510 | B2 | 8/2011 | Miyamoto et al. | |
| 8,220,282 | B2 | 7/2012 | Hast et al. | |
| 8,869,548 | B2 | 10/2014 | Piccione | |
| 10,077,917 | B2 | 9/2018 | Amick et al. | |
| 10,132,553 | B2 | 11/2018 | Booz et al. | |
| 2004/0250841 | A1 | 12/2004 | Kimbrough et al. | |
| 2007/0169495 | A1 | 7/2007 | Thomas et al. | |
| 2007/0169501 | A1 | 7/2007 | Rios | |
| 2008/0142525 | A1 | 6/2008 | Brouillette | |
| 2008/0245802 | A1 * | 10/2008 | Gray ..... | F24F 13/222 220/571 |
| 2009/0064699 | A1 | 3/2009 | Miller | |
| 2012/0159981 | A1 | 6/2012 | Beck et al. | |
| 2013/0139537 | A1 | 6/2013 | Kuijt et al. | |
| 2013/0276471 | A1 | 10/2013 | Austin et al. | |
| 2015/0041352 | A1 * | 2/2015 | Huang ..... | B65D 21/086 206/454 |
| 2017/0176056 | A1 | 6/2017 | Eicher et al. | |

FOREIGN PATENT DOCUMENTS

| | | |
|---|---|---|
| EP | 2672191 | 12/2013 |
| JP | 2010082914 | 4/2010 |
| JP | 4934307 | 5/2012 |
| KR | 20090094655 | 9/2009 |
| WO | 2007012160 | 2/2007 |
| WO | 2008084277 | 7/2008 |

* cited by examiner

MODULAR DRAIN PANS FOR HVAC SYSTEMS

CROSS REFERENCE TO RELATED APPLICATION

This application claims priority from and the benefit of U.S. Provisional Application Ser. No. 62/787,684, entitled "MODULAR DRAIN PANS FOR HVAC SYSTEMS," filed Jan. 2, 2019, which is hereby incorporated by reference in its entirety for all purposes.

BACKGROUND

The present disclosure relates generally to heating, ventilation, and/or air conditioning (HVAC) systems, and more particularly to modular drain pans for HVAC systems.

A wide range of applications exists for HVAC systems. For example, residential, light commercial, commercial, and industrial systems are used to control temperatures and air quality in indoor environments and buildings. Such systems may be dedicated to either heating or cooling, although systems are common that perform both of these functions. Very generally, these systems operate by implementing a thermal cycle in which fluids are heated and cooled to provide air flow at desired temperature to a controlled space, typically the inside of a residence or building. For example, a refrigerant circuit may circulate a refrigerant through one or more heat exchangers to exchange thermal energy between the refrigerant and one or more fluid flows, such as a flow of air.

Generally, an HVAC system may include a drain pan positioned underneath a heat exchanger, such as an evaporator, to collect condensate that may collect on and drip from outer surfaces of the heat exchanger. However, the drain pan may be installed in a tight space via connectors that are removable with tools, such that accessing the drain pan may be an equipment-intensive and difficult process. Additionally, the drain pan may include metal components that are prone to corrosion, microbial growth, and/or condensate generation. For example, the condensate collected in the drain pan may be colder than a dew point of air within the HVAC system. To prevent moisture from condensing on the bottom surface of the drain pan, a bottom surface of the drain pan may be shielded with insulating material. However, this insulation may complicate an assembly process of the drain pan and further may increase a demand for maintenance on the drain pan. Accordingly, it may be desirable to employ more versatile drain pans with improved features within HVAC systems.

SUMMARY

In one embodiment of the present disclosure, a drain pan for a heating, ventilation, and/or air conditioning (HVAC) system includes a middle section defining a cavity extending from a first end of the middle section to a second end of the middle section. The drain pan includes a first end section configured to partially extend into the cavity via the first end of the middle section. The drain pan also includes a second end section configured to partially extend into the cavity via the second end of the middle section and having a drain port configured to direct fluid out of the drain pan.

In another embodiment of the present disclosure, a drain pan assembly for a heating, ventilation, and/or air conditioning (HVAC) system includes a drain pan including a first end section including a first guide extension. The drain pan includes a second end section including an integral drain port configured to direct fluid out of the drain pan and a second guide extension. The drain pan also includes a middle section including a first wall and a second wall defining a cavity therebetween. The cavity extends from a first end of the middle section to a second end of the middle section. The first end is configured to receive the first guide extension and the second end is configured to receive the second guide extension.

In a further embodiment of the present disclosure, a method for constructing a drain pan for a heating, ventilation, and/or air conditioning (HVAC) system includes injection molding a first end section including an integral drain port and a first guide extension and injection molding a second end section including a second guide extension. The method includes extruding a middle section having a double-wall construction that defines a cavity extending from a first end of the middle section to a second end of the middle section. The method also includes assembling the first end section, the second end section, and the middle section by extending the first guide extension into the cavity via the first end of the middle section and extending the second guide extension into the cavity via the second end of the middle section to form the drain pan.

Other features and advantages of the present application will be apparent from the following, more detailed description of the embodiments, taken in conjunction with the accompanying drawings which illustrate, by way of example, the principles of the application.

DETAILED DESCRIPTION

The present disclosure is directed to a modular drain pan assembly for an HVAC system. As mentioned above, drain pans are generally installed underneath a heat exchanger to collect condensate that may drip therefrom. In contrast to corrosion and/or bacteria-prone drain pans that may be difficult to remove from the HVAC system, the present embodiments are directed to an efficiently-removable, modular drain pan that is formed from plastic with an anti-microbial additive. As a result of the use of plastic material, components of the modular drain pan may be constructed via injection molding and/or extrusion. For example, the modular drain pan may include two injection-molded end sections, where each end section has a generally vertical rim wall extending from one end and a longitudinal guide extension protruding from another end. A middle section of the modular drain pan may be coupled between the two end sections. As disclosed herein, the middle section of the modular drain pan includes double walls that define an insulating cavity for reducing sweat or condensate formation on a bottom surface of the middle section. The middle section may be formed via an extrusion process, which enables various middle sections of specified lengths to be cut from one double-walled extrudate or extruded piece. As such, a number of different stockkeeping units (SKUs) for providing appropriately-sized drain pans for different HVAC systems may be reduced.

To assemble the modular drain pan, the guide extensions of each injection-molded end section may be disposed within and coupled to a respective opening of the insulating cavity of the middle section to form a unitary condensate-collecting surface. The middle section also includes two generally vertical rim walls that each have a retention groove to enable efficient coupling of the modular drain pan to support brackets that mount underneath the heat exchanger. Moreover, the modular drain pan includes further features discussed herein that enable the modular drain pan to be efficiently manufactured, assembled, and utilized to collect condensate from underneath the heat exchanger, without reliance on traditional, tedious processes, such as welding. In these manners, the techniques disclosed herein provide a modular, anti-microbial, and sweat-resistant drain pan that may be configured for a wide range of HVAC systems.

Figure 1:
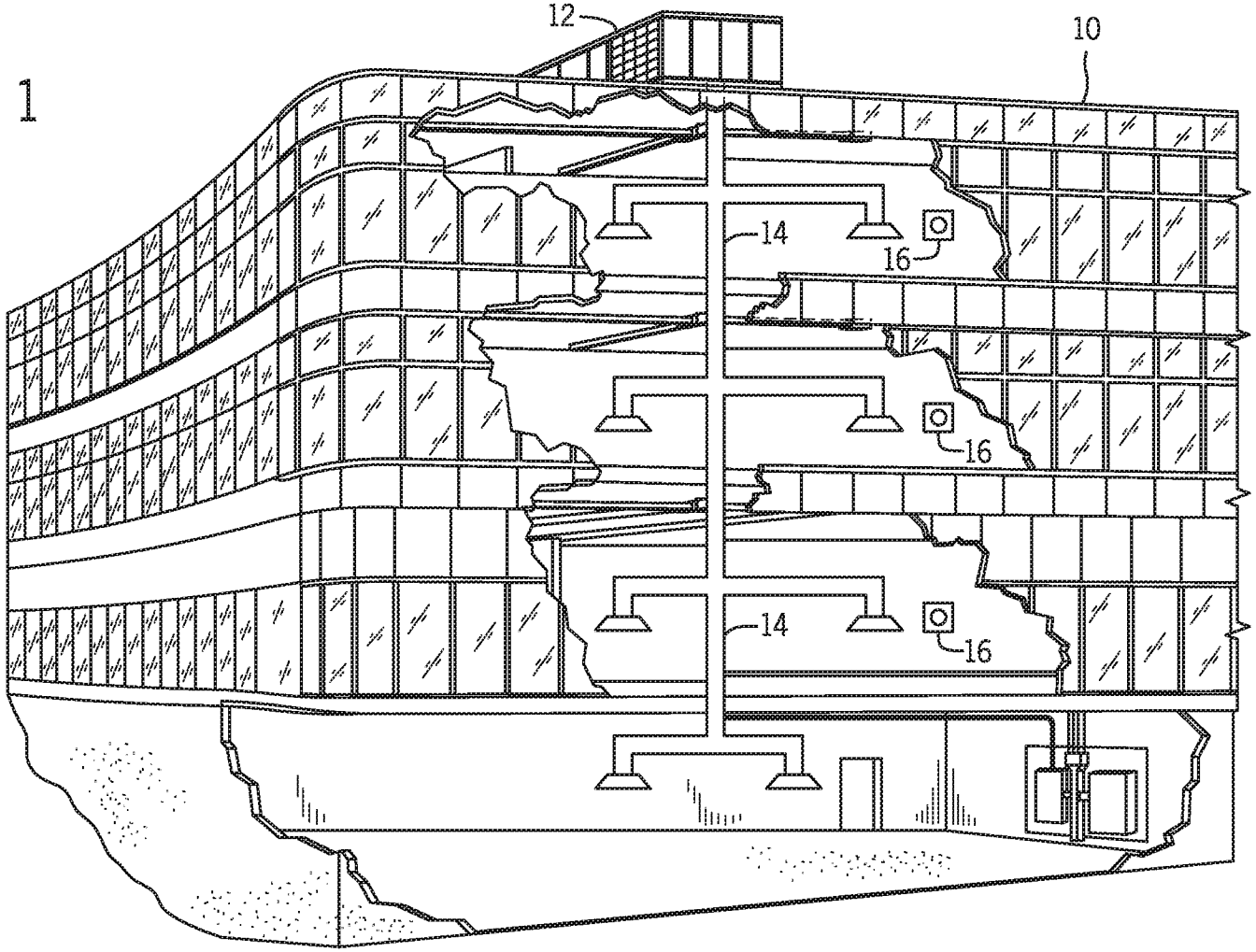
FIG. 1 is a perspective view of an embodiment of a commercial or industrial HVAC system, in accordance with an aspect of the present disclosure.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
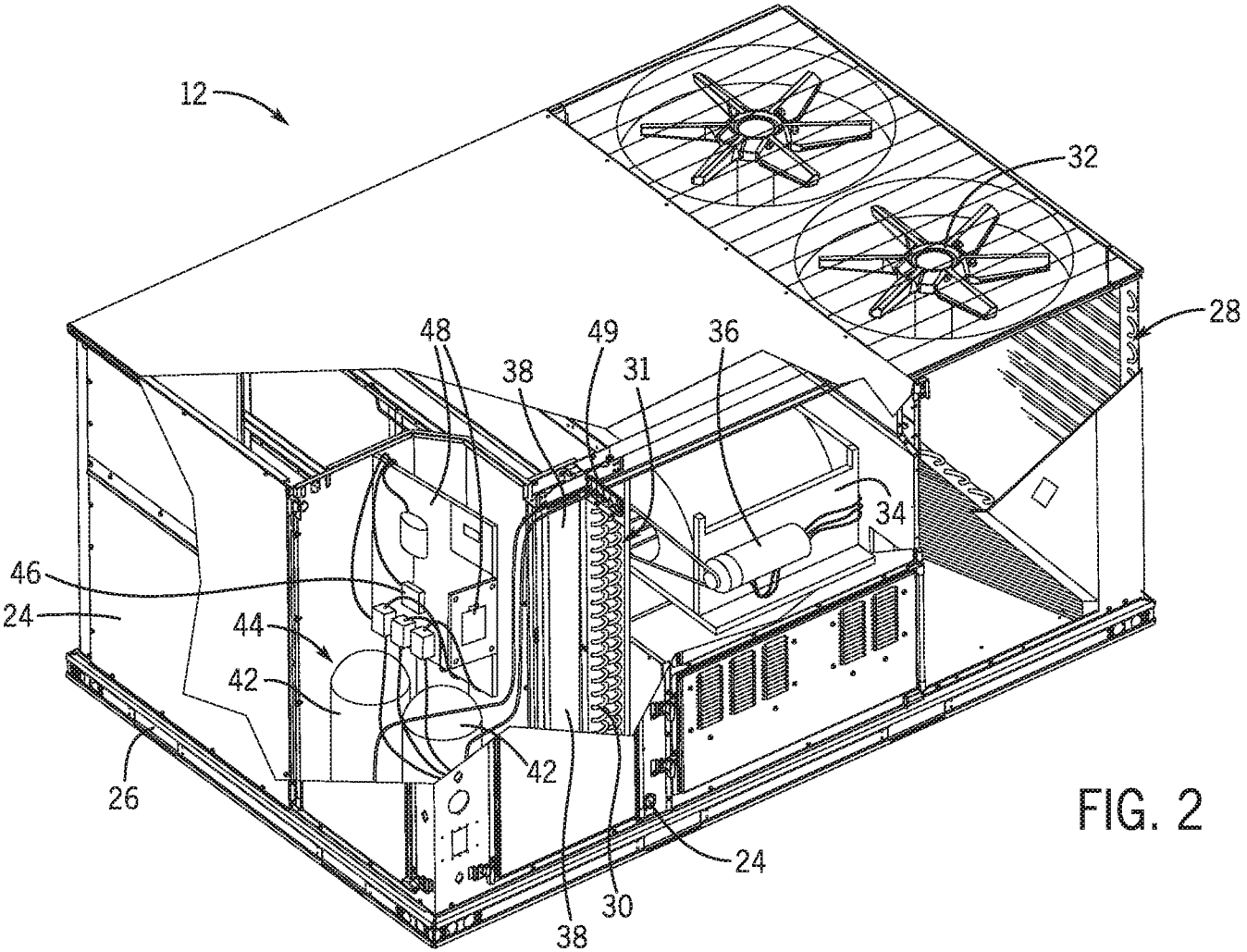
FIG. 2 is a perspective cutaway view of an embodiment of a packaged unit of an HVAC system, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
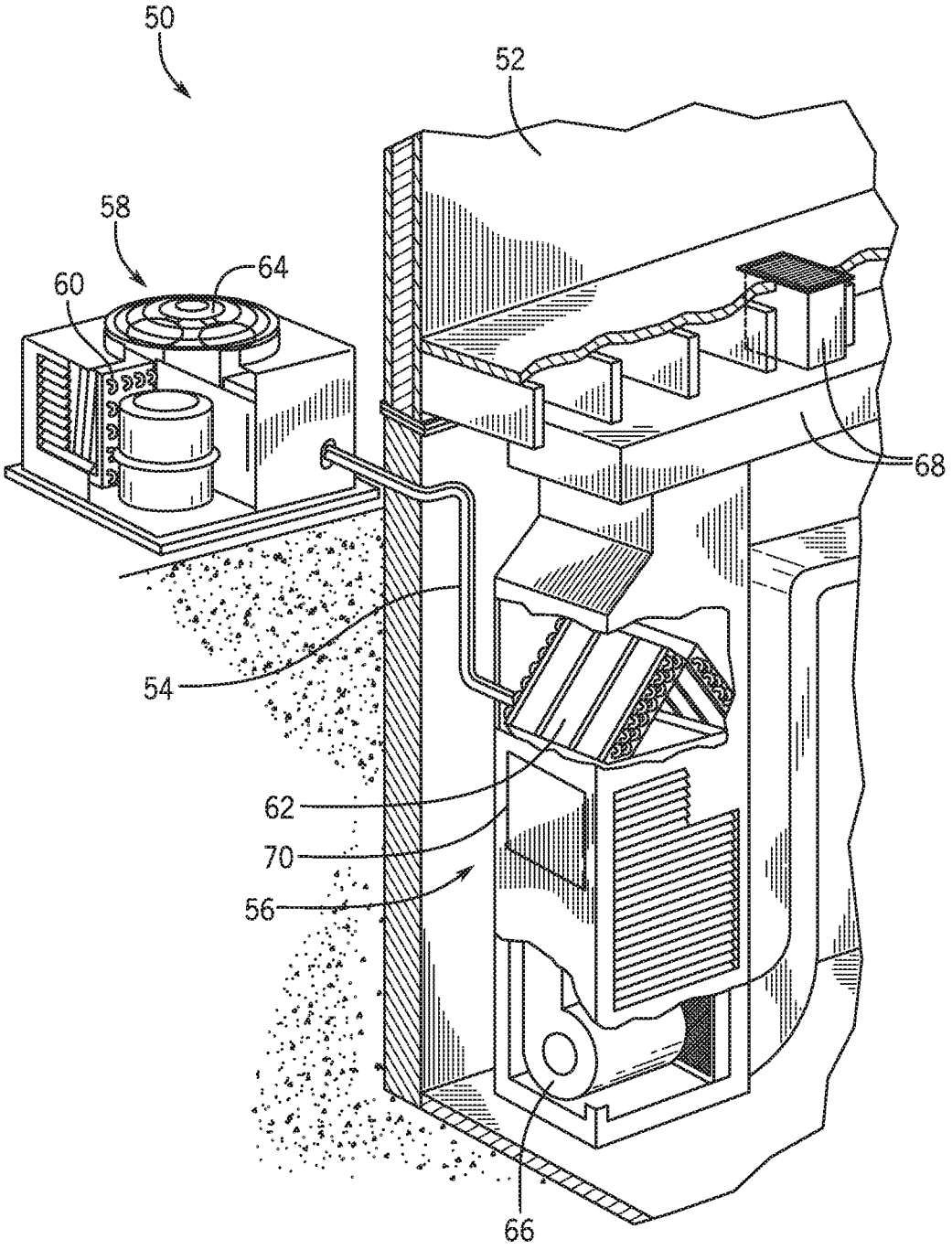
FIG. 3 is a perspective cutaway view of an embodiment of a split system of an HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 4:
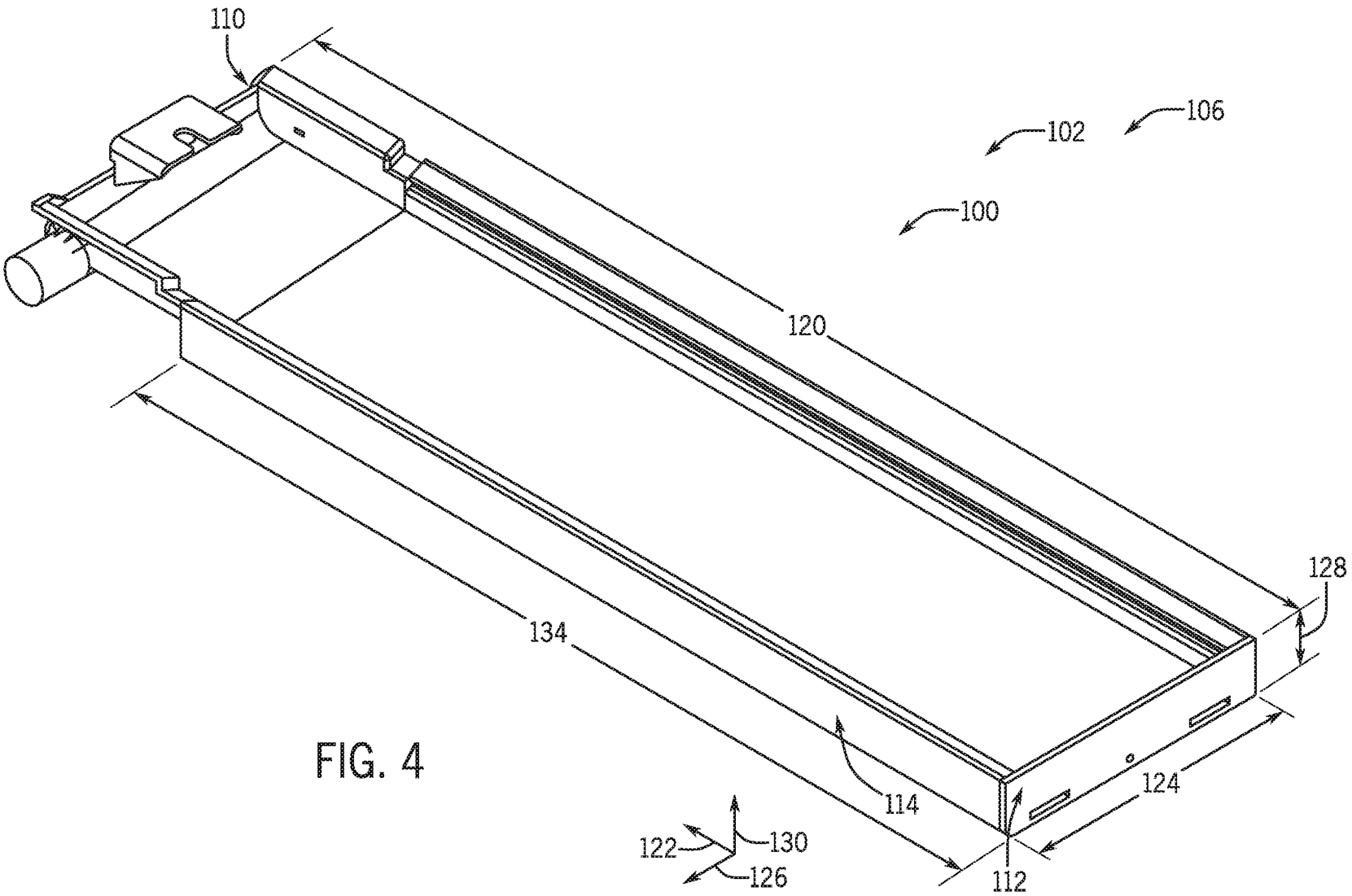
FIG. 4 is a perspective view of an embodiment of a modular drain pan for an HVAC system, in accordance with an aspect of the present disclosure.

FIG. 4 is a perspective view of an embodiment of a modular drain pan 100 of a modular drain pan assembly 102, in accordance with an aspect of the present disclosure. As previously mentioned, the modular drain pan assembly 102 may be included within an HVAC system 106 to collect condensate that may drip from outer surfaces of a heat exchanger. For example, the modular drain pan assembly 102 may include support brackets that are coupled underneath a suitable heat exchanger. Then, the modular drain pan 100 may be coupled to the support brackets without tools to selectively retain the modular drain pan 100 underneath the heat exchanger. The support brackets of the modular drain pan assembly 102 are discussed with reference to FIGS. 6 and 7 below. The heat exchanger may be any one of the heat exchangers 28, 30, 60, 62 introduced above with reference to FIGS. 2 and 3 or may be any other heat exchanger. For example, in other embodiments, the modular drain pan 100 may be used for water coils, steam coils, or any other coils from which a fluid may drip.

To illustrate operation of the modular drain pan 100 by way of example, during operation of the HVAC unit 12 of FIG. 2 having the heat exchanger 30 that operates as an evaporator, the refrigerant flowing within coils of the heat exchanger 30 may expand as it absorbs heat from air directed over the coils by the blower assembly 34. As such, the air directed over the coils may be cooled, which may cause water vapor in the air to condense on the coils. Condensate formed on the coils may drip or flow downward and be collected by the modular drain pan 100 of FIG. 4, preventing or blocking accumulation of condensate on the ground or within other portions of the cabinet 24 around the heat exchanger 30. Any particulate matter in the air may also be deposited with condensate on a surface of the coils, such that the coils and/or the modular drain pan 100 may benefit from periodic maintenance. This maintenance may include cleaning and potentially replacing the modular drain pan 100 due to accumulation of particulate matter. With this in mind, the present techniques provide for the modular drain pan 100 that may be efficiently attached to the HVAC system 106 at a location where coils of a heat exchanger are directly above the modular drain pan 100 and further, that may be conveniently removable without power tools or hand tools.

Indeed, looking now to modular components of the modular drain pan 100 that facilitate collection and removal of condensate, the modular drain pan 100 includes a drain end section 110 or first end cap, a terminal end section 112 or second end cap, and a middle section 114 or connector region coupled between the drain end section 110 and the terminal end section 112. As will be understood, each of the drain end section 110, the terminal end section 112, and the middle section 114 are single-piece elements, in some embodiments. The modular drain pan 100 constructed via these sections 110, 112, 114 or modules may therefore include a length 120 that extends along a longitudinal axis 122, a width 124 that extends along a lateral axis 126, and a height 128 that extends along a vertical axis 130.

In some embodiments, each of the end sections 110, 112 may be formed by an injection-molding process. Indeed, as discussed in more detail below, the end sections 110, 112 include a number of various, integral features that improve operation of the modular drain pan 100 by reducing manufacturing steps and improving structural strength of the modular drain pan 100, compared to drain pans to which various components are attached. The terminal end section 112 may be a universal terminal end section having a universal design or configuration that suits each modular drain pan 100 manufactured with the width 124. In these embodiments, a single mold design may be used to manufacture the terminal end section 112 for multiple model numbers of the modular drain pan 100. Similarly, the drain end section 110 of some embodiments is a universal drain end section having a universal design or configuration that suits each modular drain pan 100 manufactured with the width 124. However, in other embodiments, the drain end section 110 may be one module of at least four modules, such as modules that each have one or two drain ports that are each disposed on a first or second lateral side of the drain end section 110.

As recognized herein, the length 120 of the modular drain pan 100 may be customized by selecting or forming a module of the middle section 114 that has a desired middle section length 134. In some embodiments, the middle section 114 has a constant cross-section defined in a plane between the lateral axis 126 and the vertical axis 130, such that it may be formed by an extrusion process. For example, stock material may be pushed or directed through a die to generate an extrudate having a constant cross-section that corresponds to a desired cross-section of the middle section 114. Then, the extrudate may be separated into one or multiple middle sections 114 having a desired middle section length 134. By incorporating selected modules of the middle section 114 between selected modules of the two end sections 110, 112, a large number of modular drain pans 100 having various lengths 120 and features may be produced from a relatively small quantity of manufacturing equipment. In other embodiments, the middle section 114 may be injection-molded or each of the sections 110, 112, 114 may be constructed via additive or subtractive manufacturing processes.

Moreover, the end sections 110, 112 and the middle section 114 may each be formed of a plastic or composite material that may include an anti-microbial additive to prevent or reduce growth of microorganisms within collected condensate or otherwise within the modular drain pan 100. In some embodiments, the anti-microbial additive includes inorganic additives, such as silver ion, zinc, and/or copper, and may additionally or alternatively include organic additives, such as phenolic biocides, quaternary ammonium compounds, and/or fungicides. These anti-microbial additives may be infused into or coated onto the plastic during manufacture of the sections 110, 112, 114. As such, use of plastic and/or anti-microbial additives may improve air quality within the HVAC system 106 by inhibiting organic growth. Further, the modular drain pan 100 formed of plastic may have an increased operating life and/or reduced maintenance demands compared to drain pans formed from corrosion-prone metal or metal materials that may rust in the presence of condensate. However, it is to be understood that in other embodiments, the modular drain pan 100 may be formed of any other suitable material for collecting condensate, other fluids, and/or particulate matter, such as metal or foam.

Figure 5:
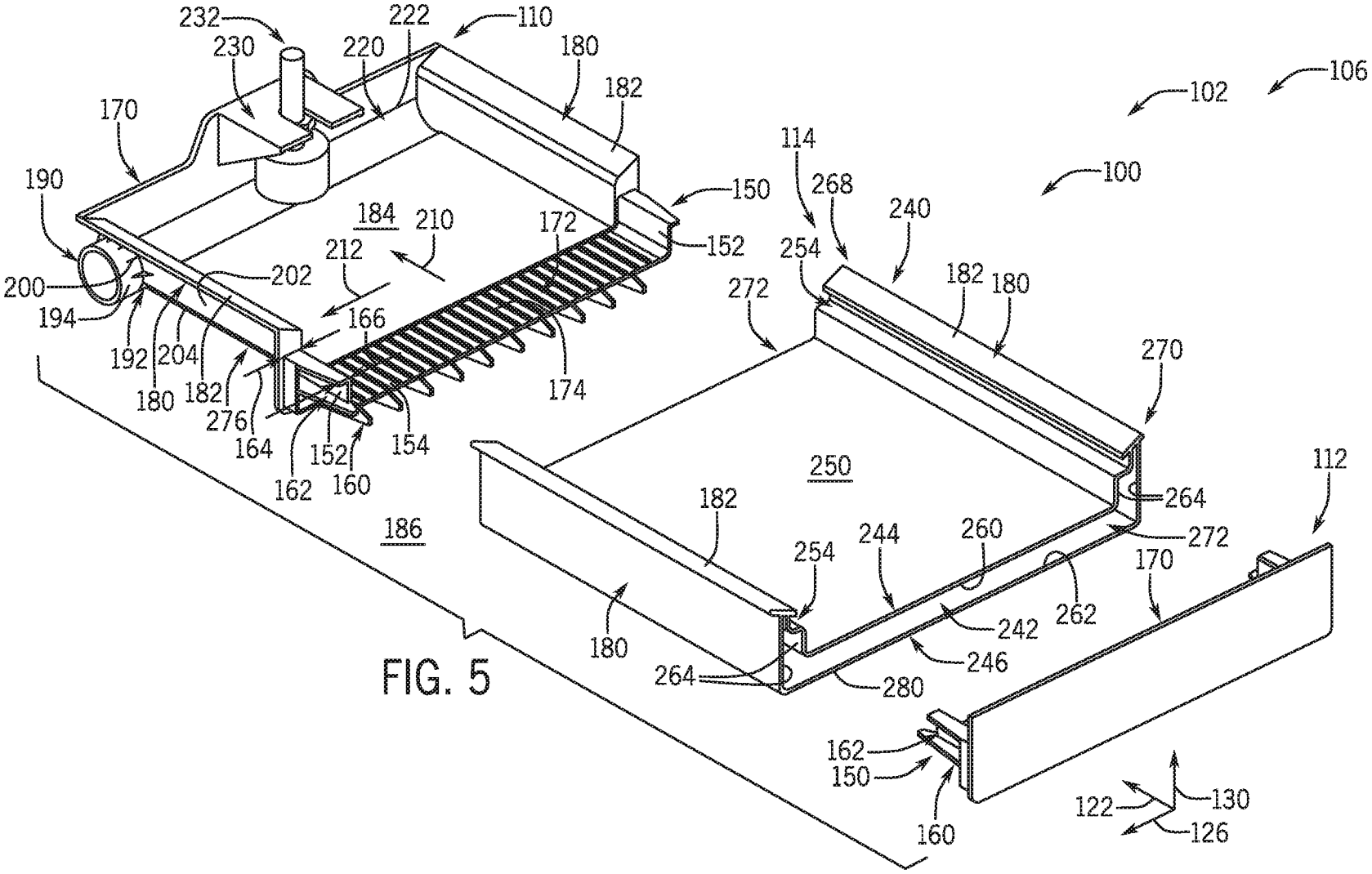
FIG. 5 is an exploded perspective view of an embodiment of a modular drain pan for an HVAC system, in accordance with an aspect of the present disclosure.

Looking to more details of the sections 110, 112, 114 of the modular drain pan 100, FIG. 5 is an exploded perspective view of an embodiment of the modular drain pan 100, in accordance with an aspect of the present disclosure. As illustrated, the drain end section 110 and the terminal end section 112 each include a guide extension 150 or connector region that facilitates coupling of the end sections 110, 112 to the middle section 114 along the longitudinal axis 122 of the modular drain pan 100. The guide extensions 150 may each have two vertically-extending portions 152 that extend from a laterally-extending portion 154 to form a U-shaped cross-section. The present embodiment of the guide extensions 150 also includes wedges 160 or prongs extending along an outer surface 162 or side of each of the guide extensions 150. The wedges 160 may be tapered toward the middle section 114 along the longitudinal axis 122, such that the wedges 160 each have a proximal protrusion height 164 that is greater than a distal protrusion height 166. As noted herein, the proximal protrusion height 164 of each wedge 160 is defined at a longitudinal position closer to a laterally-extending rim wall 170 of a respective end section 110, 112 than the distal protrusion height 166. Additionally, an upper surface 172 or side of the guide extensions 150 may include mini-ribs 174 or crush ribs thereon that enhance an interference-fit between the guide extensions 150 and the middle section 114. In some embodiments, the guide extension 150 of the drain end section 110 is a mirror-image or reflection of the guide extension 150 of the terminal end section 112 along a plane defined between the lateral axis 126 and the vertical axis 130.

The drain end section 110 of the present embodiment further includes two longitudinally-extending rim walls 180 that are integrally formed with the laterally-extending rim wall 170 of the drain end section 110. As illustrated, the longitudinally-extending rim walls 180 may each have a tapered lip 182 that directs any condensate collected on the tapered lips 182 to a condensate-collecting surface 184 or upper surface of the drain end section 110. As such, the modular drain pan 100 having the tapered lips 182 may prevent or reduce misdirection of condensate to a surrounding environment 186 outside the modular drain pan 100 compared to drain pans without the tapered lips 182. However, it is recognized herein that in other embodiments, the tapered lips 182 may be excluded from the longitudinally-extending rim walls 180 and/or may be included on the laterally-extending rim wall 170.

The drain end section 110 also includes a drain port 190 or integral drain port that extends laterally from a bottom portion 192 of one of the longitudinally-extending rim walls 180, in the present embodiment. As such, a drain pipe may be disposed over an outer surface 194 of the drain port 190 to carry away condensate collected within the drain end section 110. In other embodiments, the drain port 190 may be formed in a different wall of the drain end section 110 and/or may be accompanied by an auxiliary drain port, as discussed below with reference to FIG. 8. The modular drain pan 100 may also include a number of radial vanes 200 or support connectors that extend between the outer surface 194 of the drain port 190 and an outer surface 202 of the longitudinally-extending rim wall 180. The radial vanes 200 may provide additional structural support to the modular drain pan 100 that increases a durability of the modular drain pan 100 and the drain port 190. Indeed, because the drain port 190 is integrally formed with the drain end section 110, the drain port 190 may extend underneath a bottom surface 204 of the drain end section 110 to facilitate gravitational motivation of condensate toward the drain port 190. As discussed in more detail below, the modular drain pan 100 may include integrally-angled components and/or be coupled to support brackets that create an angled orientation of the modular drain pan 100, when installed, such that condensate is smoothly directed both in a direction 210 along the longitudinal axis 122 and in a direction 212 along the lateral axis 126 to the drain port 190 of the modular drain pan 100.

In the present embodiment, the drain end section 110 includes a laterally-extending channel 220 formed between the longitudinally-extending rim walls 180 and the drain port 190 to facilitate movement of condensate along the direction 212 toward the drain port 190. In some embodiments, the laterally-extending channel 220 is integrally sloped along the direction 212, such that the laterally-extending channel 220 has a greater depth closer to the drain port 190. The laterally-extending channel 220 of the present embodiment is formed such that an edge 222 of the laterally-extending channel 220 is directly adjacent to or in contact with the laterally-extending rim wall 170. As a result, the present embodiment of the modular drain pan 100 prevents or reduces stagnation of condensate that may occur in embodiments having a space between the laterally-extending channel 220 and the laterally-extending rim wall 170 in which condensate may accumulate.

Moreover, the drain end section 110 includes an integral float switch retention bracket 230 formed with the laterally-extending rim wall 170. The integral float switch retention bracket 230 may retain a float sensor 232 of the modular drain pan assembly 102 in a position above the laterally-extending channel 220 to enable the float sensor 232 to monitor a level or amount of condensate present within the laterally-extending channel 220. In some embodiments, the float sensor 232 is configured to provide signals and/or sensor feedback to a controller of the HVAC system 106, such as the control device 16 or control board 48 respectively discussed above with reference to FIGS. 1 and 2. The controller may be configured to deactivate the HVAC system 106 to stop generation of condensate in response to receiving a signal or instruction from the float sensor 232 indicative of a condensate level above a condensate level threshold. As such, the integral float switch retention bracket 230 may improve operation of the HVAC system 106 by reliably retaining the float sensor 232 at a suitable position in the modular drain pan 100. In some embodiments, the laterally-extending channel 220 and/or the integral float switch retention bracket 230 may be positioned in other suitable positions of the modular drain pan 100 or may be omitted. Moreover, in some embodiments in which the integral float switch retention bracket 230 is omitted, a separate float switch retention bracket may be coupled to the drain end section 110.

With the above understanding of the drain end section 110 and the terminal end section 112 in mind, further details regarding the middle section 114 may be understood in context. Indeed, the middle section 114 includes a double-wall construction 240 that defines an insulating cavity 242 or cavity between an upper wall 244 and a lower wall 246 of the middle section 114. Similar to the drain end section 110, the middle section 114 also includes two longitudinally-extending rim walls 180. The longitudinally-extending rim walls 180 of the middle section 114 are integrally formed between the upper wall 244 and the lower wall 246 of the double-wall construction 240. As illustrated, the longitudinally-extending rim walls 180 each have a tapered lip 182 that directs any condensate collected on the tapered lips 182 to a condensate-collecting surface 250 or upper surface of the middle section 114. Further, as discussed with reference to later figures, the longitudinally-extending rim walls 180 of the middle section 114 each include an integral retention groove 254 or bracket-receiving groove that enables the middle section 114 to be efficiently coupled to support brackets without tools.

The insulating cavity 242 of the present embodiment includes a U-shaped cross-section that is bounded by an inner surface 260 of the upper wall 244, an inner surface 262 of the lower wall 246, and inner surfaces 264 of the longitudinally-extending rim walls 180. Moreover, the insulating cavity 242 is open at a first longitudinal end 268 and a second longitudinal end 270 of the middle section 114 to enable efficient joining of the sections 110, 112, 114 of the modular drain pan 100. That is, during assembly of the modular drain pan 100, the guide extensions 150 of the end sections 110, 112 are directed within open ends 272 of the insulating cavity 242. In some embodiments, a U-shaped cross-section of the guide extensions 150 may correspond to or mate with the U-shaped cross-section of the insulating cavity 242, which provides further structural support and interference contact between the end sections 110, 112 and the middle section 114 compared to embodiments in which the guide extensions 150 exclude the vertically-extending portions 152. The wedges 160 of the guide extensions 150 may additionally facilitate positioning of the guide extensions 150 into respective target positions within the insulating cavity 242. Moreover, the wedges 160 engage with the upper wall 244 and the lower wall 246 of the middle section 114 to prevent convergence of or contact between the upper wall 244 and the lower wall 246.

Although the interference fit between the guide extensions 150 and the middle section 114 may sufficiently retain the end sections 110, 112 with the middle section 114, adhesive may be applied to the guide extensions 150 and/or the middle section 114, in some embodiments, before assembly of the modular drain pan 100 to permanently or non-reversibly couple the sections 110, 112, 114 together. In such embodiments, the adhesive may be applied around all or a portion of a respective perimeter of each guide extension 150 and/or each open end 272 of the insulating cavity 242. The adhesive may include any suitable epoxies, polyurethanes, polyimides, or other material for retaining the guide extensions 150 in the insulating cavity 242. It is to be understood that the guide extensions 150 and the middle section 114 may alternatively be coupled by any other suitable joining mechanism, such as latches, clips, magnets, snap-fit components, and so forth. Accordingly, the connection between the sections 110, 112, 114 is substantially air-tight and/or water-tight, such that the insulating cavity 242 is fully bounded on all sides to maintain an insulating volume of air therein.

In addition to enabling efficient assembly of the modular drain pan 100, the insulating cavity 242 of the middle section 114 also provides a thermal break that prevents or reduces condensate formation on a bottom surface 280 of the lower wall 246 of the middle section 114. For example, a bottom surface of a drain pan without an insulating cavity 242 may be cooled as relatively cool condensate drips onto the drain pan. If cooled below a dew point of ambient air around the drain pan, the bottom surface may undesirably sweat or accumulate condensate from the ambient air. To reduce sweating, the bottom surface of the drain pan may be fitted with insulation that may become worn and/or be replaced over time. As recognized herein, the double-wall construction 240 of the middle section 114 provides improved performance, decreased maintenance, and reduced construction steps compared to drain pans without insulating cavities 242. However, the middle section 114 having the insulating cavity 242 may be fitted with insulation, in some embodiments, to further improve thermal resistance of the middle section 114. Additionally, in some embodiments, the drain end section 110 may also include a double-wall construction and/or be fitted with insulation 276 on the bottom surface 204 or other outer surfaces of the drain end section 110. However, due to its smaller surface area and/or position downstream of the middle section 114 relative to the direction 210 in which condensate may flow, the drain end section 110 may receive less condensate directly from the heat exchanger than the middle section 114.

Figure 6:
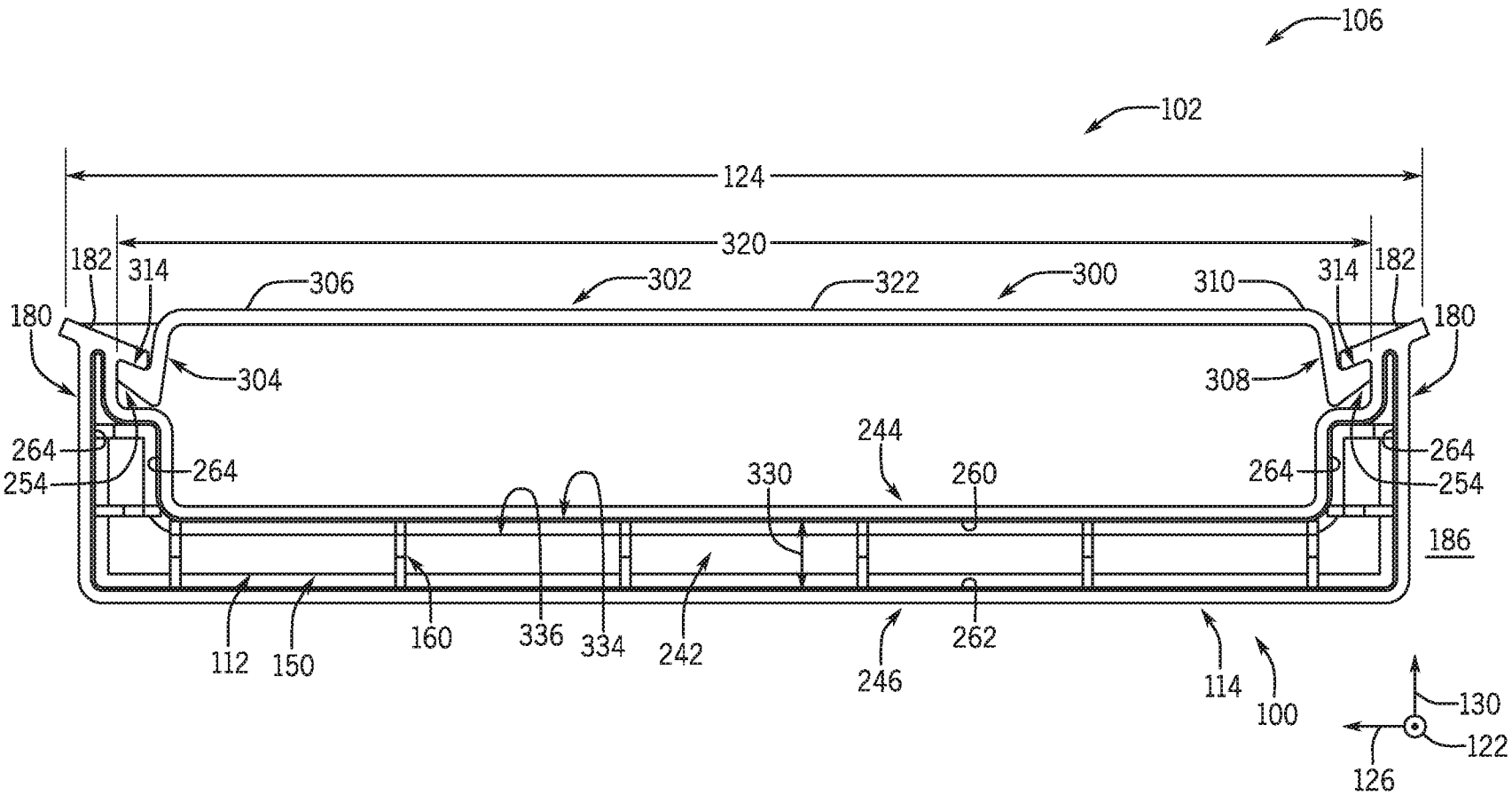
FIG. 6 is a cross-sectional side view of an embodiment of a modular drain pan assembly for an HVAC system, in accordance with an aspect of the present disclosure.

To enable further understanding of the middle section 114, FIG. 6 is a cross-sectional side view of an embodiment of the modular drain pan assembly 102, in accordance with an aspect of the present disclosure. The modular drain pan assembly 102 includes a support bracket 300 that is coupled to or engaged with the integral retention groove 254 of the modular drain pan 100. The support bracket 300 may include a flat portion 302 having openings through which fasteners may extend to install or mount the modular drain pan 100 underneath the heat exchanger. Then, the modular drain pan 100 may be manually and reversibly coupled to the support bracket 300 to collect condensate from the heat exchanger. In particular, a first leg 304 of the support bracket 300 extends from a first end 306 of the flat portion 302, and a second leg 308 the support bracket 300 extends from a second end 310 of the flat portion 302. Each leg 304, 308 includes a retention flange 314 that is configured to engage with the respective integral retention groove 254 of the middle section 114. The integral retention grooves 254 are partially defined by the tapered lips 182 discussed above. Indeed, because the legs 304, 308 of the support bracket 300 may be flexible, the retention flanges 314 may be manually snap-fitted within the integral retention grooves 254. The modular drain pan 100 may therefore be inserted and/or removed from underneath the heat exchanger without tools, reducing difficulties associated with other drain pans that are only removable with tools. Moreover, the support bracket 300 has a length 320 defined along the lateral axis 126 that is less than the width 124 of the modular drain pan 100. As such, any condensate that is deposited on an upper surface 322 of the support bracket 300 may flow into the modular drain pan 100 instead of into the surrounding environment 186. The support bracket 300 may be formed of the same plastic with the anti-microbial additive as the sections 110, 112, 114 of the modular drain pan 100 or, in other embodiments, may be formed of any other suitable material for supporting the modular drain pan 100.

As illustrated, the middle section 114 defines the insulating cavity 242 therein that provides a separation distance 330 between the inner surface 260 of the upper wall 244 and the inner surface 262 of the lower wall 246. Lateral ends of the insulating cavity 242 relative to the lateral axis 126 are bound by the inner surfaces 264 of the longitudinally-extending rim walls 180, providing a U-shaped cross-section 334 to the insulating cavity 242. Additionally, the guide extension 150 of the terminal end section 112 has a corresponding U-shaped cross-section 336 that is received within the U-shaped cross-section 334 of the insulating cavity 242. The wedges 160 of the guide extension 150 are disposed between the upper wall 244 and lower wall 246, maintaining the separation distance 330 between the upper wall 244 and lower wall 246. In other embodiments, the guide extension 150 and the insulating cavity 242 may have any other suitable corresponding cross-sections that maintain a suitable insulating cavity, such as a rectangular cross-section.

Figure 7:
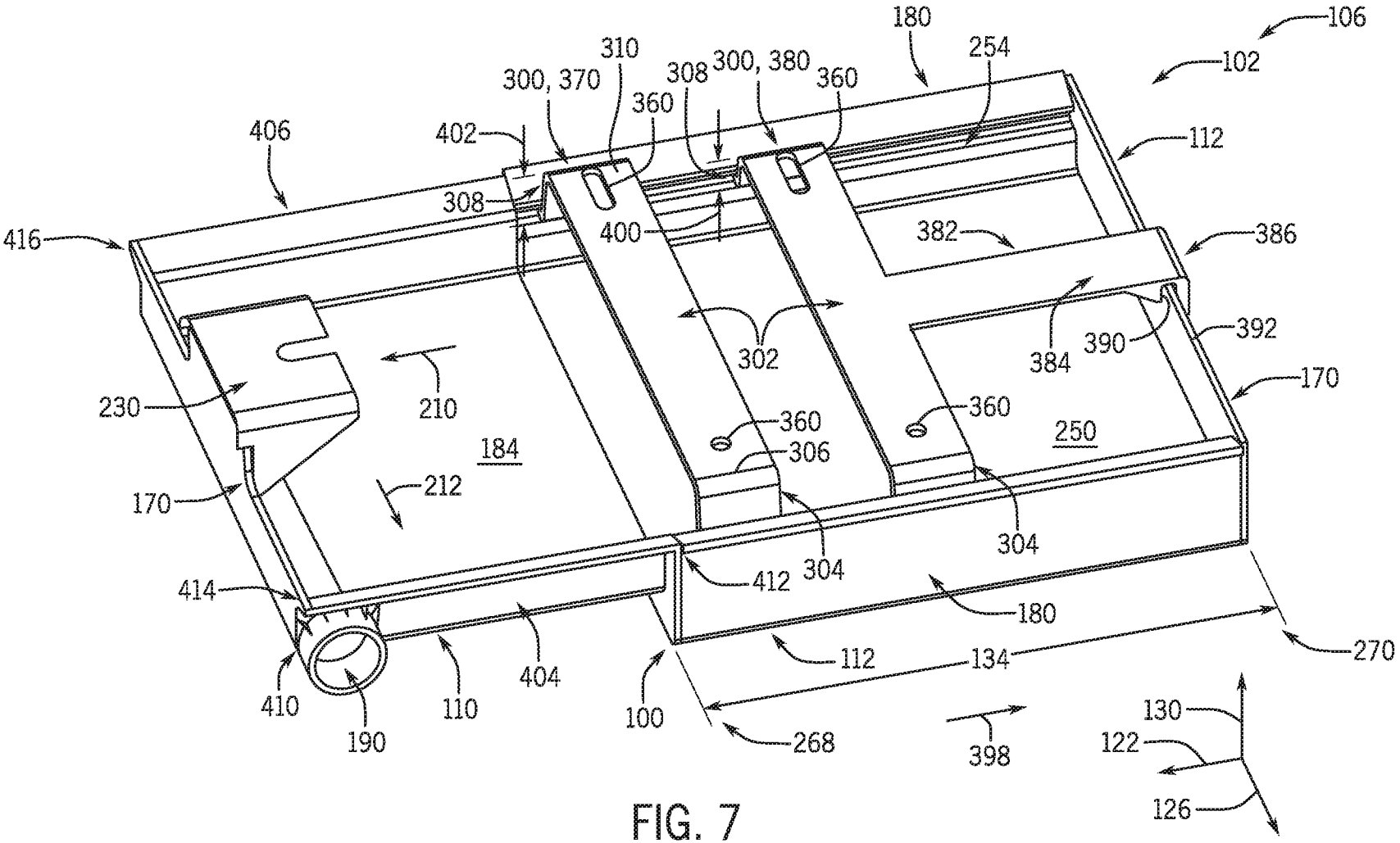
FIG. 7 is a perspective view of an embodiment of a modular drain pan assembly having support brackets coupled to a modular drain pan, in accordance with an aspect of the present disclosure.

FIG. 7 is a perspective view of an embodiment of the modular drain pan assembly 102 having two support brackets 300 coupled to the modular drain pan 100, in accordance with an aspect of the present disclosure. The support brackets 300 may each be mounted underneath the heat exchanger by disposing fasteners through openings 360 defined through the respective flat portions 302 of the support brackets 300, as discussed above. Then, the first leg 304 and second leg 308 of each support bracket 300 may be fitted or snap-fitted within the respective integral retention grooves 254 of the middle section 114 to position the modular drain pan 100 underneath the heat exchanger. In the illustrated embodiment, one support bracket 300 is a U-shaped bracket 370 that includes the first leg 304 and the second leg 308 each extending from the respective ends 306, 310 of the flat portion 302. The other support bracket 300 is a locking bracket 380 that further includes a locking arm 382 extending longitudinally from the flat portion 302 at a lateral position between the first leg 304 and the second leg 308.

In the present embodiment, a distal end portion 384 of the locking arm 382 includes a retainer 386 having a groove 390 that may be disposed over an upper edge 392 of the laterally-extending rim wall 170 of the terminal end section 112 to fix a position of the modular drain pan 100 along the longitudinal axis 122 relative to the support brackets 300. It will be appreciated that coupling the integral retention grooves 254 of the middle section 114 to the legs 304, 308 of the U-shaped bracket 370 and the locking bracket 380 may fix a position of the modular drain pan 100 along both the lateral axis 126 and the vertical axis 130. However, because the integral retention grooves 254 extend along the middle section length 134 of the middle section 114, the modular drain pan 100 may be moved along a direction 398 in the longitudinal axis 122. Movement of the modular drain pan 100 along the direction 398 may adjust a position of the legs 304, 308 until the groove 390 of the retainer 386 of the locking arm 382 is disposed over the laterally-extending rim wall 170 of the terminal end section 112. In these manners, use of the support brackets 300 enables efficient adjustment of the modular drain pan 100 to a target operating position underneath the heat exchanger, where the support brackets 300 may maintain the position of the modular drain pan 100. Moreover, it is to be understood that a handle may be integrally formed with or coupled to either laterally-extending rim wall 170 of the modular drain pan 100 to facilitate removal and replacement of the modular drain pan 100 from underneath the heat exchanger.

The support brackets 300 may each have a respective bracket height that encourages collected condensate to flow in the direction 210 along the longitudinal axis 122 and/or in the direction 212 along the lateral axis 126 toward the drain port 190. For example, the locking bracket 380 of the illustrated embodiment has a bracket height 400 that is shorter than a bracket height 402 of the U-shaped bracket 370. As such, once installed on the support brackets 300, the drain end section 110 of the modular drain pan 100 will be tipped downward along the vertical axis 130. Moreover, in some embodiments, the first legs 304 of the support brackets 300 may be longer than the second legs 308 of the support brackets 300, such that a first lateral side 404 of the modular drain pan 100 is tipped downward relative to a second lateral side 406. In certain embodiments, each leg 304, 308 of each support bracket 300 has a respective height to cause the modular drain pan 100 to be tipped or sloped relative to two axes 122, 126 after installation. In some embodiments, the locking bracket 380 is omitted from and another U-shaped bracket 370 is included in the modular drain pan assembly 102.

As mentioned above, the sections 110, 114 of the modular drain pan 100 may also be formed with the respective condensate-collecting surfaces 184, 250 that are integrally sloped, even when the modular drain pan 100 is not attached to the support brackets 300. For example, the middle section 114 may include an incline defined from the first longitudinal end 268 of the middle section 114 to the second longitudinal end 270 of the middle section 114 that directs condensate toward the drain end section 110. As illustrated, the condensate-collecting surface 250 of the middle section 114 is flush with the condensate-collecting surface 184 of the drain end section 110, causing little to no resistance to condensate flow from the middle section 114 to the drain end section 110. In some embodiments, the drain end section 110 may be integrally sloped both in the direction 210 along the longitudinal axis 122 and in the direction 212 along the lateral axis 126. As noted herein, the direction 210 is crosswise to the direction 212. For example, a first incline may be defined from a first longitudinal end 410 of the drain end section 110 to a second longitudinal end 412 of the drain end section 110 that directs condensate toward the laterally-extending channel 220 of the drain end section 110. Additionally, a second incline of the drain end section 110 may be defined from a first lateral end 414 of the drain end section 110 to a second lateral end 416 of the drain end section 110 that directs condensate toward the first lateral end 414 of the drain end section 110. In embodiments in which one or both of the middle section 114 and the drain end section 110 are integrally sloped, the integral slopes may be further exaggerated by coupling the modular drain pan 100 to support brackets 300 that retain the modular drain pan 100 in a tipped position. In other embodiments, the middle section 114 may be integrally sloped in two planes, the drain end section 110 may be integrally sloped in one plane, or the middle section 114 and the drain end section 110 may exclude integral slopes and rely on the support brackets 300 to motivate condensate flow toward the drain port 190. As such, the modular components of the modular drain pan assembly 102 cooperate to efficiently manage condensate collected from the heat exchanger.

Figure 8:
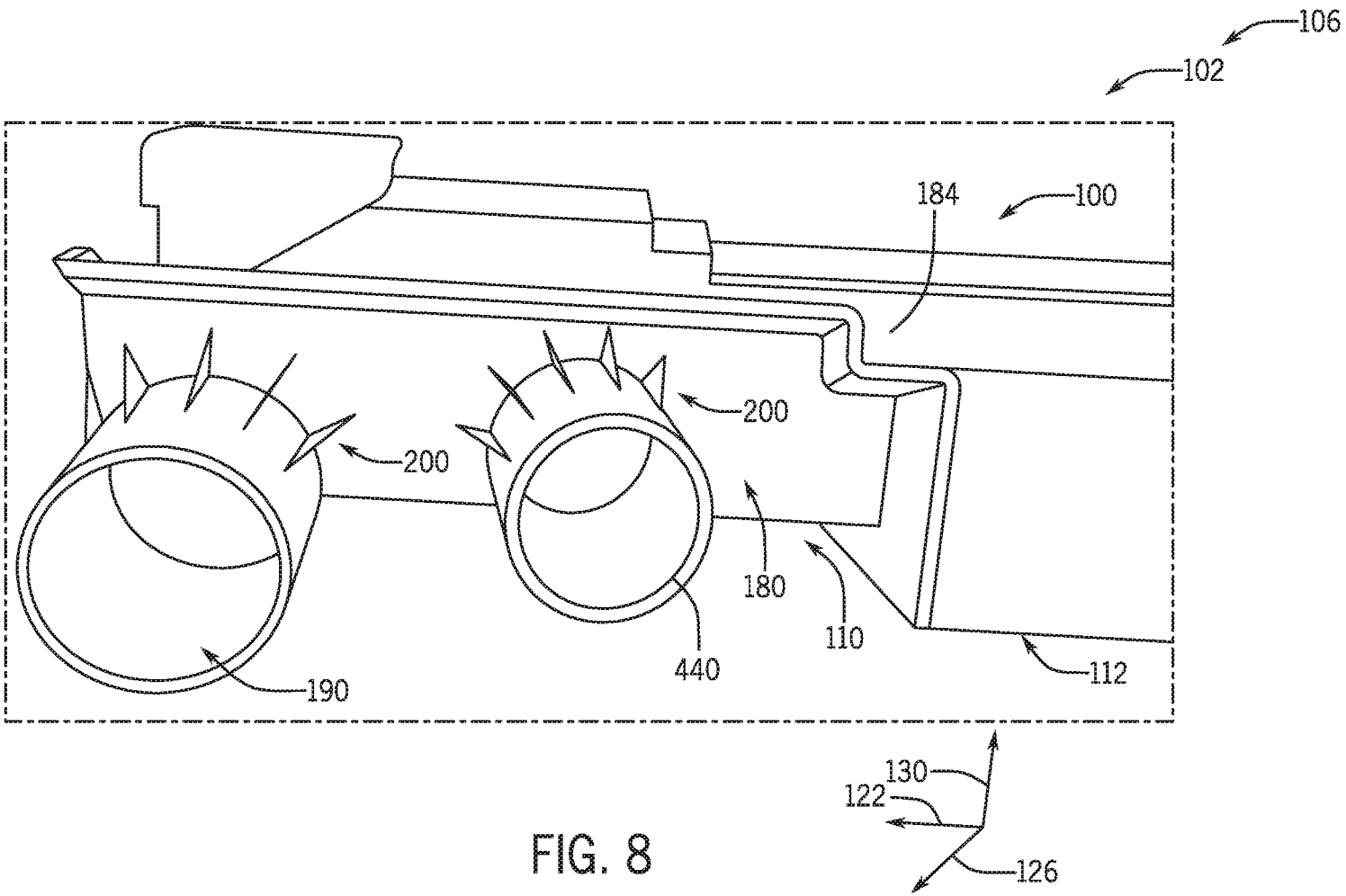
FIG. 8 is a perspective view of an embodiment of a modular drain pan having two drain ports, in accordance with an aspect of the present disclosure.

FIG. 8 is a perspective view of an embodiment of the modular drain pan 100 in which the drain port 190 is a main drain port that is accompanied by an auxiliary drain port 440, in accordance with an aspect of the present disclosure. The main drain port 190 and the auxiliary drain port 440 are each integrally formed within the longitudinally-extending rim wall 180 of the drain end section 110. The modular drain pan 100 may be integrally angled and/or tipped to dispose the main drain port 190 at a lowest vertical position within the modular drain pan assembly 102. As such, the auxiliary drain port 440 of the present embodiment is positioned at a smaller or lesser distance from the condensate-collecting surface 184 of the drain end section 110 than the main drain port 190. With this positioning, should the main drain port 190 be unable to remove condensate from the modular drain pan 100 as fast as condensate is collected within the modular drain pan 100, a liquid level of the condensate may rise until condensate reaches the auxiliary drain port 440. In the present embodiment, the auxiliary drain port 440 has a diameter that is smaller than the diameter of the main drain port 190. However, in other embodiments, the auxiliary drain port 440 may have a diameter that is the same as or larger than the diameter of the main drain port 190.

As such, embodiments of the modular drain pan 100 having the main drain port 190 and the auxiliary drain port 440 may provide a desirable backup condensate outlet for HVAC systems 106 that generate significant amounts of condensate. Moreover, the drain ports 190, 440 each include five radial vanes 200, as discussed above with reference to FIG. 5, to increase the strength and rigidity of the drain ports 190, 440. In other embodiments, another suitable number of radial vanes 200 may be included on one or both of the drain ports 190, 440, or the radial vanes 200 may be omitted.

Accordingly, embodiments discussed herein are directed to a modular drain pan 100 with modules formed from plastic with an anti-microbial additive via injection molding and extrusion processes. As such, the modular drain pan 100 may be utilized to collect condensate from underneath a heat exchanger with an increased maintenance interval between services or cleanings. The modules of the modular drain pan 100 may include a drain end section 110, a terminal end section 112, and a middle section 114 to be coupled between the end sections 110, 112. To facilitate assembly of the modules into the modular drain pan 100, the drain end section 110 and the terminal end section 112 of the modular drain pan 100 may each include universal guide extensions 150 that may be coupled to a middle section 114 of any suitable middle section length 134. For example, the middle section 114 may have a consistent U-shaped cross-section along the middle section length 134 that enables the middle section 114 to be efficiently constructed via extrusion of an intermediate component. The intermediate component may therefore be cut or separated into the middle section 114 having the desired middle section length 134. The middle section 114 further includes an insulating cavity 242 defined therein to increase a thermal resistance of the middle section 114 and reduce condensate formation on a bottom surface of the middle section 114. Additionally, the middle section 114 and/or the drain end section 110 may be integrally sloped to naturally direct condensate toward a drain port 190 formed in a corner portion of the drain end section 110. In some embodiments, the modular drain pan 100 is coupled to support brackets 300, such as a U-shaped bracket 370 and a locking bracket 380. These support brackets 300 may maintain the modular drain pan 100 in an angled position after installation of the modular drain pan 100 underneath the heat exchanger. As such, the modular drain pan assembly 102 having the modular drain pan 100 and the support brackets 300 may be efficiently constructed without welding and may be utilized within an HVAC system 106 to collect and remove condensate therefrom.

While only certain features and embodiments of the present disclosure have been illustrated and described, many modifications and changes may occur to those skilled in the art, such as variations in sizes, dimensions, structures, shapes and proportions of the various elements, values of parameters, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A drain pan for a heating, ventilation, and/or air conditioning (HVAC) system, comprising:

a middle section defining a cavity extending from a first end of the middle section to a second end of the middle section, wherein the middle section includes a first wall and a second wall that define the cavity;

a first end section configured to partially extend into the cavity via the first end of the middle section, wherein the first end section includes a first guide extension configured to extend into the cavity via the first end of the middle section; and a second end section configured to partially extend into the cavity via the second end of the middle section and having a drain port configured to direct fluid out of the drain pan, wherein the second end section includes a second guide extension configured to extend into the cavity via the second end of the middle section, wherein the first guide extension and the second guide extension each include a plurality of wedges configured to engage with the first wall and the second wall to prevent convergence of the first wall and the second wall, wherein the second guide extension includes a first side and a second side, wherein the plurality of wedges of the second guide extension are formed on the first side of the second guide extension, and wherein the second end section includes a plurality of ribs formed on the second side of the second guide extension to facilitate coupling of the second end section to the middle section.

2. The drain pan of claim 1, wherein the middle section, the first end section, and the second end section are each made of a plastic having an anti-microbial additive.

3. The drain pan of claim 1, wherein the middle section, the first end section, and the second end section are each a single-piece element.

4. The drain pan of claim 1, wherein the second end section includes an integral float switch retention bracket.

5. The drain pan of claim 1, wherein the middle section includes an integral retention groove configured to couple to a support bracket that is mounted underneath a heat exchanger of the HVAC system to enable the drain pan to capture the fluid from the heat exchanger.

6. The drain pan of claim 1, wherein the middle section includes rim walls having tapered lips, and wherein the tapered lips are angled toward an upper surface of the middle section configured to direct the fluid toward the drain port.

7. The drain pan of claim 1, wherein the drain port is integrally formed with the second end section, and wherein the second end section includes a plurality of radial vanes extending between an outer surface of the drain port and an outer surface of the second end section.

8. The drain pan of claim 1, wherein the drain port is a main drain port formed in a wall of the second end section, and wherein the second end section includes an auxiliary drain port integrally formed in the wall of the second end section.

9. The drain pan of claim 1, wherein the second end section includes a first lateral side, a second lateral side, and a channel, wherein the drain port is formed in the first lateral side, and wherein the channel extends from the second lateral side to the drain port.

10. The drain pan of claim 1, wherein the second end section and the middle section each include a condensate-collecting surface, and wherein adjacent ends of the respective condensate-collecting surfaces are flush with one another.

11. A drain pan assembly for a heating, ventilation, and/or air conditioning (HVAC) system, comprising:

a drain pan including:

a first end section including a first guide extension;

a second end section including an integral drain port configured to direct fluid out of the drain pan and a second guide extension; and a middle section including a first wall and a second wall defining a cavity therebetween, wherein the cavity extends from a first end of the middle section to a second end of the middle section, and wherein the first end is configured to receive the first guide extension and the second end is configured to receive the second guide extension;

a first support bracket having a first flat portion, a first leg, and a second leg, wherein the first leg and the second leg each extend from the first flat portion; and a second support bracket having a second flat portion, a third leg, and a fourth leg, wherein the third leg and the fourth leg each extend from the second flat portion, and wherein a distal end of each of the first leg, the second leg, the third leg, and the fourth leg is configured to engage an integral retention groove of the middle section.

12. The drain pan assembly of claim 11, wherein the first guide extension and the second guide extension each include a wedge configured to engage with the first wall and the second wall to prevent convergence of the first wall and the second wall.

13. The drain pan assembly of claim 11, wherein a condensate-collecting surface of the second end section is sloped toward the integral drain port in a longitudinal direction and in a lateral direction, and wherein the longitudinal direction is crosswise to the lateral direction.

14. The drain pan assembly of claim 11, wherein the middle portion is plastic.

15. The drain pan assembly of claim 11, wherein each of the first leg and the second leg are shorter than each of the third leg and the fourth leg to cause the middle section of the drain pan to be angled toward the integral drain port after installation of the drain pan, the first support bracket, and the second support bracket in the HVAC system.

16. The drain pan assembly of claim 11, wherein the middle section includes the integral retention groove, and wherein the first support bracket and the second support bracket are configured to be mounted underneath a heat exchanger of the HVAC system to enable the drain pan to capture fluid from the heat exchanger.

17. The drain pan assembly of claim 16, wherein the first support bracket is configured to be mounted underneath the heat exchanger via the first flat portion, wherein the first leg includes a first retention flange, wherein the second leg includes a second retention flange, wherein the first retention flange is configured to engage with the integral retention groove on a first side of the middle section, and wherein the second retention flange is configured to engage with the integral retention groove on a second side of the middle section.

18. The drain pan assembly of claim 17, wherein the first support bracket is a locking bracket, wherein the locking bracket includes a locking arm extending from the first flat portion, and wherein the locking arm is configured to couple to a wall of the first end section after installation of the drain pan on the locking bracket.

19. A drain pan assembly for a heating, ventilation, and/or air conditioning (HVAC) system, comprising:

a drain pan comprising:

a first end section including a first guide extension;

a second end section including a second guide extension and an integral drain port configured to direct fluid out of the drain pan; and a middle section including a first wall and a second wall defining a cavity therebetween, wherein the cavity extends from a first end of the middle section to a second end of the middle section, wherein the first end is configured to receive the first guide extension and the second end is configured to receive the second guide extension, and wherein the middle section includes an integral retention groove configured to couple to a support bracket that is mounted underneath a heat exchanger of the HVAC system to enable the drain pan to capture fluid from the heat exchanger; and the support bracket, wherein the support bracket comprises:

a flat portion having a first end and a second end, wherein the support bracket is configured to be mounted underneath the heat exchanger via the flat portion;

a first leg extending from the first end and having a first retention flange; and a second leg extending from the second end and having a second retention flange, wherein the first retention flange is configured to engage with the integral retention groove on a first side of the middle section, and wherein the second retention flange is configured to engage with the integral retention groove on a second side of the middle section.

20. The drain pan assembly of claim 19, wherein the first guide extension and the second guide extension each include a wedge configured to engage with the first wall and the second wall to prevent convergence of the first wall and the second wall.

21. The drain pan assembly of claim 19, wherein a condensate-collecting surface of the second end section is sloped toward the integral drain port in a longitudinal direction and in a lateral direction, and wherein the longitudinal direction is crosswise to the lateral direction.

22. The drain pan assembly of claim 19, wherein the middle portion is plastic.

23. The drain pan assembly of claim 19, wherein the support bracket is a first support bracket, wherein the drain pan assembly comprises a second support bracket having a third leg and a fourth leg, and wherein each of the first leg and the second leg are shorter than each of the third leg and the fourth leg to cause the middle section of the drain pan to be angled toward the integral drain port after installation of the drain pan, the first support bracket, and the second support bracket in the HVAC system.

24. The drain pan assembly of claim 19, wherein the support bracket is a locking bracket, wherein the locking bracket includes a locking arm extending from the flat portion, and wherein the locking arm is configured to couple to a wall of the first end section after installation of the drain pan on the locking bracket.

25. The drain pan assembly of claim 19, wherein the middle section, the first end section, and the second end section are each a single-piece element.

26. The drain pan assembly of claim 19, wherein the second end section includes an integral float switch retention bracket.

27. The drain pan assembly of claim 19, wherein the middle section includes rim walls having tapered lips, and wherein the tapered lips are angled toward an upper surface of the middle section configured to direct the fluid toward the integral drain port.

28. The drain pan assembly of claim 19, wherein the second end section includes a plurality of radial vanes extending between an outer surface of the integral drain port and an outer surface of the second end section.

29. The drain pan assembly of claim 19, wherein the integral drain port is a main integral drain port formed in a wall of the second end section, and wherein the second end section includes an auxiliary integral drain port formed in the wall of the second end section.

* * * * *